United States Patent [19]

Welker et al.

[11] Patent Number: 4,559,469

[45] Date of Patent: Dec. 17, 1985

[54] GREEN EMITTING PHOSPHOR AND CATHODE-RAY TUBE PROVIDED WITH SUCH A PHOSPHOR

[75] Inventors: Thomas Welker, Monschau; Klaus Carl; Wolfram Czarnojan, both of Aachen, all of Fed. Rep. of Germany

[73] Assignee: U.S. Philips Corporation, New York, N.Y.

[21] Appl. No.: 725,145

[22] Filed: Apr. 19, 1985

Related U.S. Application Data

[63] Continuation of Ser. No. 559,079, Dec. 7, 1983, abandoned.

[30] Foreign Application Priority Data

Dec. 29, 1982 [DE] Fed. Rep. of Germany ..... 3248448

[51] Int. Cl.[4] ..... H01J 29/20

[52] U.S. Cl. ..... 313/468; 252/301.4 F; 252/301.4 S; 252/301.4 H; 252/301.6 F

[58] Field of Search ..... 252/301.6 F, 301.4 H; 313/468

[56] References Cited

FOREIGN PATENT DOCUMENTS

| | | | |
|---|---|---|---|
| 57-90851 | 6/1982 | Japan | 313/467 |
| 57-124838 | 8/1982 | Japan | 252/301.4 S |
| 57-174832 | 10/1982 | Japan | 252/301.4 S |
| 857212 | 8/1981 | U.S.S.R. | 252/301.4 S |

*Primary Examiner*—Jack Cooper

*Attorney, Agent, or Firm*—Norman N. Spain

[57] ABSTRACT

A green emitting phosphor for heavily loaded cathode-ray tubes comprises a mixture of a deep-green and a yellowish-green emitting phosphor. Mixtures of $Zn_2SiO_4$:Mn and at least one phosphor from the group comprising $Y_2SiO_5$:Tb; $X_2O_2S$:Tb; ES:Ce and XOZ:Tb, where X=Y, La, Gd, Lu; E=Ca, Sr, Ba; and Z=Cl, Br, I, F; satisfy, as FIG. 1 illustrates for a few examples, the EBU specification.

3 Claims, 2 Drawing Figures

GREEN EMITTING PHOSPHOR AND CATHODE-RAY TUBE PROVIDED WITH SUCH A PHOSPHOR

This is a continuation of application Ser. No. 559,079, filed Dec. 7, 1983, now abandoned.

The invention relates to a green emitting phosphor for heavily loaded cathode-ray tubes, which phosphor comprises a mixture of a deep-green and a yellowish-green emitting phosphor.

In colour picture tubes, namely in normally loaded cathode-ray tubes, $Y_2O_3$:Eu or $Y_2O_2S$:Eu is normally used as red, ZnS:Cu, Au or (Zn,Cd)S:Cu as green and ZnS:Ag as blue phosphor ("Funkschau" 44, (1972) 81–84). The intrinsic energy and lumen outputs of these phosphors are measured according to a standard at low energy and current densities of the exciting electron beam.

Under the usual operating conditions of a colour picture tube (acceleration voltage U=25 kV, average current density in the electron beam $i \approx 2.10^{-2}$ A/cm$^2$), the highest image brightness B and white D-luminance can be attained with the last-mentioned phosphors. Therefore, the colour points of these phosphors are the basis for the standardization by the EBU (European Broadcasting Union) of the primary colour locations of colour television systems ("EBU Standards for Chromaticity Tolerances for Studio Monitors", Tech 3213-E, Brussels, August 1977).

The energy and lumen outputs are measured, as already stated, with low excitation densities. Especially with the phosphors of the ZnS type there is observed a decrease of the outputs with increasing energy density of the electron beam. This phenomenon is generally designated as saturation. Under the aforementioned operating conditions of a colour picture tube (energy density $W \approx 10^{-4}$ J/cm$^2$), the phosphors of the ZnS type have—depending upon composition and method of manufacturing—a saturation of up to 20%.

With heavily loaded cathode-ray tubes, such as, for example, tubes for projection television, the known effect of the temperature extinction is superimposed on this intrinsic saturation behaviour: Since the energy and lumen outputs decrease with increasing temperature of the phosphor, with high energy densities of the electron beam the phosphor can reach temperatures which lead to a considerable decrease of the tube brightness. By a suitable choice of the phosphor and/or by suitable cooling measures, attempts are made to mitigate this effect in practice.

In heavily loaded cathode-ray tubes, the saturation of the green emitting phosphors of the ZnS type can lead to a drastic decrease of their lumen output, that is to say that with an increase of the current density of the exciting electron beam practically no increase of the tube brightness is observed any longer. In order to avoid these saturation effects, alternative phosphors are used. It is known, for example, from EP-OS No. 30 853 to use in heavily loaded cathode-ray tubes, such as, for example, projection tubes, as green emitting phosphor $Zn_2SiO_4$:Mn, $Gd_2O_2S$:Tb, $Y_2O_2S$:Tb or CaS:Ce, because these phosphors have with a heavily current load a higher lumen output than the green emitting phosphors on the basis of ZnS or (Zn,Cd)S. Further examples of alternative phosphors are $Y_2SiO_5$:Tb and LaOBr:Tb. All the alternative phosphors have a lower saturation than the phosphors of the ZnS type. However, with the use of these phosphors, a correct colour picture display cannot be obtained because their emission colours do not satisfy the EBU standard for colour television systems. This is based on the fact that the colour points of the alternative phosphors lie outside the EBU tolerance range. Therefore, their use leads to colour shade errors because "an ideal colour picture transmission between transmitter (object) and receiver (image) is possible only when the transmitter side and on the receiver side the same primary colour locations are used" ("Funkschau" 44 (1972), 81–84).

It is known from DE-OS No. 2944815 to use for colour television projection devices phosphors activated by ions of rare earth elements because the occurrence of the phenomenon of the saturation of the brightness under the influence of the irradiating electron beam is considerably reduced thereby. Praseodimium- and terbium-activated oxide-sulphide phosphors containing rare earth elements have a green and a yellowish-green emission colour, respectively, which, however, in both cases greatly differs from the colour shade of the conventional ZnS:Cu, Au and (Zn,Cd)S:Cu phosphors, respectively. Moreover, the lumen output of praseodimium-activated oxide-sulphide phosphors containing rare earth elements is insufficient—as stated in DE-OS No. 29 44 815. According to DE-OS No. 29 44 815, therefore a mixture is prepared of this praseodimium-activated phosphor with terbium-activated oxide-sulphide phosphors. The emission colour of this mixture leaves much to be desired, however, for the following reasons: Since the colour point of the praseodimium-activated phosphor has only a slightly higher value of the colour coordinate y in the CIE diagram (y=0.627) than the EBU standard (y=0.60), for reasons of principle, no "more strongly saturated green" emission colours can be realized in the EBU tolerance range (CIE=Commission Internationale d'Eclairage).

The invention has for its object to provide a green emitting mixed phosphor for heavily loaded cathode-ray tubes, such as, for example, projection tubes, which has the great advantages of the aforementioned one-component phosphors (low saturation, high extinction temperature, comparatively high lumen output) and at the same time exhibits colour coordinates according to the EBU standard for colour television systems so that a correct colour picture transmission is obtained.

According to the invention, this is achieved in that the mixture consists of $Zn_2SiO_4$:Mn and at least one phosphor from the group comprising $Y_2SiO_5$:Tb, $X_2O_2S$:Tb, ES:Ce and XOZ:Tb, where X is at least one of the elements Y, La, Gd and Lu; E is at least one of the elements Ca, Sr and Ba; and Z is at least one of the elements Cl, Br, I and F.

By mixing the colour-saturated deep-green phosphor $Zn_sSiO_4$:Mn with "green" phosphors, whose colour coordinates are shifted to "yellow" or "green-white/yellow", a mixed phosphor can thus be prepared whose lumen output continuously passes from the value of the one component to that of the other component. Such a mixed phosphor has the following advantageous properties:

Location of the colour point within the EBU tolerance range.

The saturation behaviour (intrinsically and thermally) is equally favourable as that of the individual components.

The principle of mixing two phosphors known from DE-OS No. 29 44 815 is comparable with that of the mixture according to the invention, it is true, but the DE-OS No. 29 44 815 only relates to the mixture of a yellow emitting $Gd_2O_2S$:Tb phosphor with a green emitting $Gd_2O_2S$:Pr phosphor. According to the invention, on the contrary, mixing occurs with a green emitting $Zn_2SiO_4$:Mn phosphor in order to improve the colour. The use of $Zn_2SiO_4$:Mn has the following advantages:

The emission colour of $Zn_2SiO_4$:Mn (colour coordinates x=0.21; y=0.71) is saturated more strongly in green than that of $Gd_2O_2S$:Pr (x=0.215; y=0.627) so that when mixing with a yellow emitting phosphor the colour point can be shifted in a large range (especially to higher y values in the CIE diagram).

The lumen output of $Zn_2SiO_4$:Mn is higher than that of $Gd_2O_2S$:Pr. Consequently, a viewing screen obtained with the mixture according to the invention has a higher brightness or luminous power.

The cost of the starting materials of $Zn_2SiO_4$:Mn is lower than that of $Gd_2O_2S$:Pr.

In case under the operating conditions of the cathode-ray tube an inadmissible shift of the colour points can be expected because of the non-identical saturation behaviour (inclusive of thermal effects) of the two components, this can be avoided by a correct choice of the mixing ratio. Preferred weight ratios of the mixtures are:

$Zn_2SiO_4$:Mn:$Y_2SiO_5$:Tb=2:8 to 4:6.

$Zn_2SiO_4$:Mn:$Gd_2O_2S$:Tb=3:7 to 4:6.

$Zn_2SiO_4$:Mn:CaS:Ce=2:8 to 5:5.

$Zn_2SiO_4$:Mn:LaOBr:Tb=4:6 to 6:4.

The invention will be described more fully with reference to a drawing and a few examples. In the drawing:

FIG. 1 represents the colour coordinates x and y of $Zn_2SiO_4$:Mn, $Gd_2O_2S$:Tb and LaOBr:Tb and the corresponding mixed phosphors. The EBU tolerance range is indicated by a tetragon with broken side lines.

Figure 2:
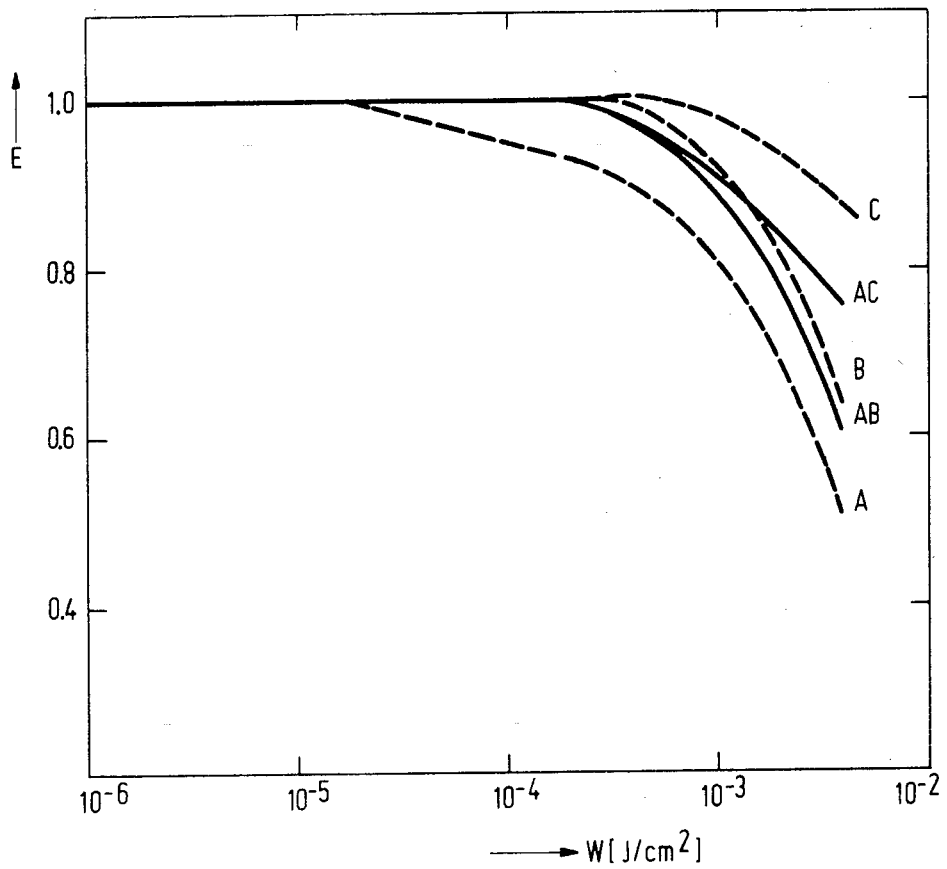
FIG. 2 shows a graph of the saturation behaviour.

In FIG. 2 the relative energy output E is plotted against the energy density per pulse, W, in J/cm$^2$. FIG. 2 shows at an acceleration voltage of the electrons U=25 kV the saturation behaviour of $Zn_2SiO_4$:Mn (curve A), $Gd_2O_2S$:Tb (curve B), LaOBr:Tb (curve C) and of the phosphor mixtures of $Zn_2SiO_4$:Mn with $Gd_2O_2S$:Tb (curve AB) and with LaOBr:Tb (curve AC).

EXAMPLES

Example 1

$Zn_2SiO_4$:Mn and $Gd_2O_2S$:Tb phosphors are mixed in in the weight ratio 4:6 in the dry state. By dispersion of both phosphor components in a 0.1% $K_2SiO_3$ solution, these components are mixed sufficiently. A screen glass for a projection tube is coated by sedimentation in a $Ba(NO_3)_2$ solution to which the phosphor dispersion is added. The weighted in quantity of phosphor is employed so that the thickness of the phosphor layer corresponds to a layer weight of 2 to 10 mg/cm$^2$. After the phosphor layer has been coated with a lacquer film that can be baked out, a thin Al film is applied by vapour deposition. Subsequently, the luminescent screen is baked out.

Figure 1:
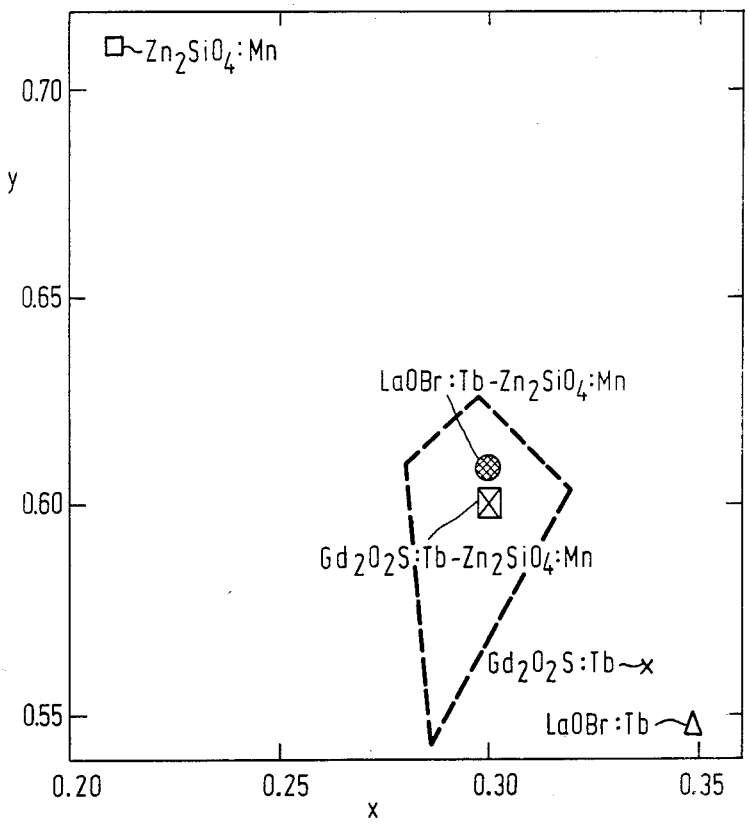
FIG. 1 shows a part of the CIE colour diagram.

FIG. 1 shows that the mixed phosphor $Gd_2O_2S$:Tb-$Zn_2SiO_4$:Mn satisfies the EBU specification with respect to its emission colour. The measured lumen outputs and colour points of the mixture and its subcomponents are indicated in the table. The mixed phosphor has a lumen output of 49 lm/W. Its saturation behaviour is compared in FIG. 2 (curve AB) with that of the mixture components $Zn_2SiO_4$:Mn (curve A) and $Gd_2O_2S$:Tb (curve B).

Example 2

A luminescent screen is manufactured in the manner described for Example 1. However, in this case, the phosphor mixture consists of 6:4 parts by weight of LaOBr:Tb and $Zn_2SiO_4$:Mn. FIG. 1 shows that the emission colour of this mixed phosphor satisfies the EBU specifications. The measured lumen outputs and colour points of this mixture and of its components are indicated in the table. The saturation behaviour of this mixture is plotted in FIG. 2 (curve AC) and is compared with the saturation behaviour of LaOBr:Tb (curve C).

Example 3

A luminescent screen is manufactured in the manner shown for Example 1. However, in this case, the mixture consists of 8:2 parts by weight of $Y_2SiO_5$:Tb and $Zn_2SiO_4$:Mn. A lumen output of 31 lm/W and a colour point of x=0.31′ y=0.61 are measured on this luminescent screen.

Example 4

A mixture of 7:3 parts by weight of the phosphors CaS:Ce and $Zn_2SiO_4$:Mn is dispersed in an apolar solvent and is sedimented onto the screen glass of a projection tube. A lumen output of 57 lm/W and a colour point of x=0.30; y=0.59 are measured on this screen.

TABLE

| Phosphor | weight ratio of the mixture | colour points and lumen outputs measured on luminescent screens: colour x | point y | lumen output Lm/W |
|---|---|---|---|---|
| $Zn_2SiO_4$:Mn | | 0.21 | 0.71 | 36 |
| $Gd_2O_2S$:Tb | | 0.34 | 0.56 | 57 |
| LaOBr:Tb | | 0.35 | 0.55 | 56 |
| $Y_2SiO_5$:Tb | | 0.34 | 0.58 | 30 |
| CaS:Ce | | 0.32 | 0.57 | 66 |
| $Gd_2O_2S$:Tb-$Zn_2SiO_4$:Mn | 6:4 | 0.30 | 0.60 | 49 |
| LaOBr:Tb-$Zn_2SiO_4$:Mn | 6:4 | 0.31 | 0.60 | 48 |
| $Y_2SiO_5$:Tb-$Zn_2SiO_4$:Mn | 8:2 | 0.31 | 0.61 | 31 |
| CaS:Ce-$Zn_2SiO_4$:Mn | 7:3 | 0.30 | 0.59 | 67 |

What is claimed is:

1. A green emitting phosphor composition for heavily loaded cathode-ray tubes, which phosphor composition consists of a mixture of a deep green emitting phosphor of the formula $Zn_2SiO_4$:Mn and a yellowish-green emitting phosphor, of the formula XOZ:Tb in the following weight ratios:

$Zn_2SiO_4$:Mn:XOZ:Tb=4:6 to 6:4 where

X is at least one element selected from the group consisting of Y, La, Gd and Lu and Z is at least one of the elements selected from the group consisting of Cl, Br, I and F, said phosphor composition exhibiting color coordinates x and y within the tetragon with broken side lines in FIG. 1.

2. The green emitting phosphor composition of claim 1 wherein the phosphor composition consists of the following mixture in the following weight ratios:

$Zn_2SiO_4$:Mn:LaOBr:Tb=4:6 to 6:4.

3. A cathode-ray tube provided with a phosphor composition as claimed in claim 2.

* * * * *